United States Patent [19]

Kahl et al.

[11] Patent Number: 4,703,171

[45] Date of Patent: Oct. 27, 1987

[54] LIGHTING CONTROL SYSTEM WITH INFRARED OCCUPANCY DETECTOR

[75] Inventors: William Kahl, Brookfield; Richard Settanni, Bethel, both of Conn.

[73] Assignee: Target Concepts Inc., Brookfield, Conn.

[21] Appl. No.: 795,098

[22] Filed: Nov. 5, 1985

[51] Int. Cl.[4] ..... H01J 40/14

[52] U.S. Cl. ..... 250/221; 340/567

[58] Field of Search ..... 250/203, 216, 221, 342, 250/353; 340/567; 362/276, 802; 315/149, 159

[56] References Cited

U.S. PATENT DOCUMENTS

| | | | |
|---|---|---|---|
| 3,958,118 | 5/1976 | Schwarz | 250/221 |
| 4,258,255 | 3/1981 | Guscott | 250/221 |
| 4,450,351 | 5/1984 | Fraden | 362/276 X |
| 4,523,095 | 6/1985 | Keller-Steinbach | 250/342 X |
| 4,644,147 | 2/1987 | Züblin | 250/221 |

*Primary Examiner*—Eugene R. LaRoche
*Assistant Examiner*—David Mis
*Attorney, Agent, or Firm*—Darby & Darby

[57] ABSTRACT

A lighting control device utilizes an infrared occupancy detector in order to control the lights in a room or area. The occupancy detector monitors changes in infrared energy, which indicate movement within the area, by receiving infrared energy in a plurality of fields of view spread out over an arc of approximately 180°. As a result the device may be installed on a wall of a room or area and still cover the entire area. The wide spread of the fields of view is accomplished with off-axis Fresnel lens segments arranged in series and by partially reflecting the energy received by some of the lens segments into the infrared detector.

21 Claims, 8 Drawing Figures

LIGHTING CONTROL SYSTEM WITH INFRARED OCCUPANCY DETECTOR

BACKGROUND OF THE INVENTION

This invention relates to lighting control systems and, more particularly, to lighting control systems which operate automatically to provide illumination when a room is occupied.

Up to 50% of the electric energy costs for a commercial building are for lighting. Much of this cost is wasted, either because the area illuminated in the building is unoccupied or is sufficiently illuminated during daylight hours by sunlight passing through windows. Some static methods have been used to improve the situation. These include removing lamps from certain fixtures and using lamps which are more efficient than conventional incandescent and fluorescent lights. However, in more recent years automatic lighting control systems have been used.

These automatic systems adjust the amount of electrically generated illumination in response to the ambient sunlight available and also automatically turn off the lights when the room or area is unoccupied.

A simple form of automated control employs computers or timers to turn the lights on and off at preset times. This occurs so that after working hours the lights are not accidentally left on. The problem with such a system is that frequently it is necessary to have the lights on at night for maintenance and cleaning personnel, as well as regular employees who must work late.

A more sophisticated system uses photodiodes to control the lighting system based on available ambient lighting. Such a system can turn off unneeded lights or dim their output when sufficient sunlight is available. An example of such a system is disclosed in U.S. Pat. No. 4,383,288 of Hess, et al.

With photodetector type lighting control systems, there is still wasted energy because lights are not turned off in unoccupied areas. One way of correcting this is by incorporating occupancy detectors into the control system. Such detectors may operate by utilizing ultrasonic or infrared detectors. These devices use shifts in received ultrasonic or infrared energy to indicated movement of a person into and within the area. If no movement is detected within a particular period of time, the system turns off the lights in the area.

Commercial examples of ultrasonic control systems are sold under the tradename Enertron UD and Light-O-Matic Model 01-071. These devices, however are subject to false triggering due to noise vibrations unrelated to the occupancy of the room. Thus they are inaccurate and highly unreliable.

Lighting systems controlled by passive infrared sensors are much less sensitive to extraneous signals than ultrasonic models. Commercial versions of these systems are sold by United technologies under the name Infracon. This type of device, however, can only cover an arc of about 60° because passive infrared detectors are characterized by a lambertian distribution of sensitivity. In particular the sensitivity decreases as the cosine of the angle from the optical axis. Thus at an angle of 30° from the optical axis the sensitivity is only half what it is at the center. As a result the signal-to-noise ratio is decreased at the edges of a 60° arc and the effectiveness of the detector is lessened.

One way to improve the effective arc of an infrared detector is to employ a lens to direct the heat energy from a wider angle into the effective area of the lens. Such a system is sold under the name LightWatch by Colorado Electro-Optics. This device uses two Fresnel lenses and has an effective arc of about 90°.

In a typical room the most useful detector would be a passive infrared type with an effective arc approaching at least 180°. In such an arrangement the detector could be located near one wall and could scan the entire room for heat changes that indicate occupancy of the room. However, there are no known prior art detectors with this capability.

SUMMARY OF THE INVENTION

The present invention is directed to the provision of wide-angle fields of view for a passive infrared detector utilized in lighting control systems. This extended field of view is achieved with an optical system employing curved, contiguous segmented, off-axis lenses.

In an illustrative embodiment of the invention lights in a room or area are turned on and off automatically depending on whether the room or area is occupied. Occupancy in the room is detected by means of a passive infrared sensor. Whenever the detector indicates that there is a change in the heat received within its field of view, a signal is produced in a circuit means which causes the lights in the room to be turned on. The lights remain in the on condition for a fixed period of time, e.g., a few minutes, and then turn off unless there are additional changes in the heat received by the detector, which would indicate movement of an occupant within the room.

The signal from the circuit means typically controls an SCR or triac device which controls the electrical energy delivered to the lights in the room. Only changes in heat energy are detected by a.c. coupling the detector signal to the circuit means.

In order to spread the field of view of the detector over a range up to, and even exceeding, 180° and to compensate for the typical Lambertian distribution of sensitivity of detectors, a unique optical system is provided. This optical system includes a plurality of off-axis lens segments and a reflective surface.

A preferred embodiment of the invention employs twelve (12) lens elements, six (6) on each side of the optical axis. Each of the segments of the lens creates a field of view for the infrared detector, which fields of view are approximately 15° apart. To establish the two fields of view at the extremes of the arc on each side of the axis, reflective surfaces are located immediately in front of the detector and are positioned to reflect infrared energy received at the two endmost lens segments on each side of the arc directly into the middle of the detector. The other four lens segments on each side of the central axis refract infrared energy directly to the detector without reflection. Through the use of these off-axis lenses it is possible to position the fields of view created by each of the lens segments at desired positions.

Of those segments which pass infrared energy directly to the detector, the ones most remote from the center axis of the detector will be the least sensitive because of the Lambertian effect. However, since the reflective surfaces direct the infrared energy from the even more remote lens segments at an angle directly into the detector, a relatively uniform sensitivity is achieved over the entire arc of sensitivity of the detector.

BRIEF DESCRIPTION OF THE DRAWINGS

The foregoing and other features of the present invention will be more readily apparent from the following detailed description and drawings of illustrative embodiments of the invention in which.

DESCRIPTION OF ILLUSTRATED EMBODIMENTS

Figure 1:
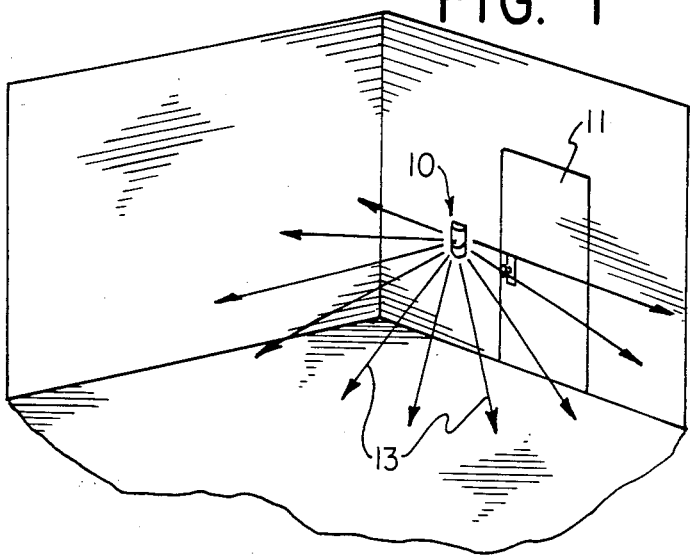
FIG. 1 is a perspective diagrammatic view of a portion of a room equipped with the present invention.

In FIG. 1 there is shown a perspective view, partially broken, of a room equipped with the present invention. In particular the room has a passive infrared detector device 10 mounted on a wall adjacent a door 11. The device 10 has a plurality of fields of view 13 shown as arrows. The number and spacing of these fields is preselected and, for example, may total twelve (12) fields of view extending over an arc of nearly 180°.

The twelve (12) fields of view are spaced about 15° apart. The two end fields are not positioned at 90° with respect to the center line of the device 10. Rather, they are spaced at approximately 82.5° from the center line. This has been done so that the end field of view will not look directly down the wall upon which the sensor has been mounted. The endmost fields are at a slight angle from the wall, e.g. at approximately 7.5° from the wall. The effect of this is to place the first field of view approximately 3 feet from the wall at 25 feet from the sensor. Thus one of the available fields will not be wasted in scanning a wall but yet will be sufficiently close to the wall that it will detect a person entering the room through the door 11.

Since the device 10 is designed to control the lighting in the room it must be connected into the normal lighting electrical wiring system. Further, the detector and its associated circuitry require power. Therefore, a most convenient location for the device 10 is as a replacement for the normal light switch in a typical switch box. These boxes are usually located along the wall near the entrance door to the room. Thus they are in an ideal position for detecting entry into the room because of the nearly 180° arc of the fields of view. Additionally, these boxes are typically located at such a height that the fields of view for the detector intersect the positions of either standing or sitting occupants in the room. Thus power for the device, a connection to the lighting load to be controlled, and a proper scan height are found at this location.

Figure 2:
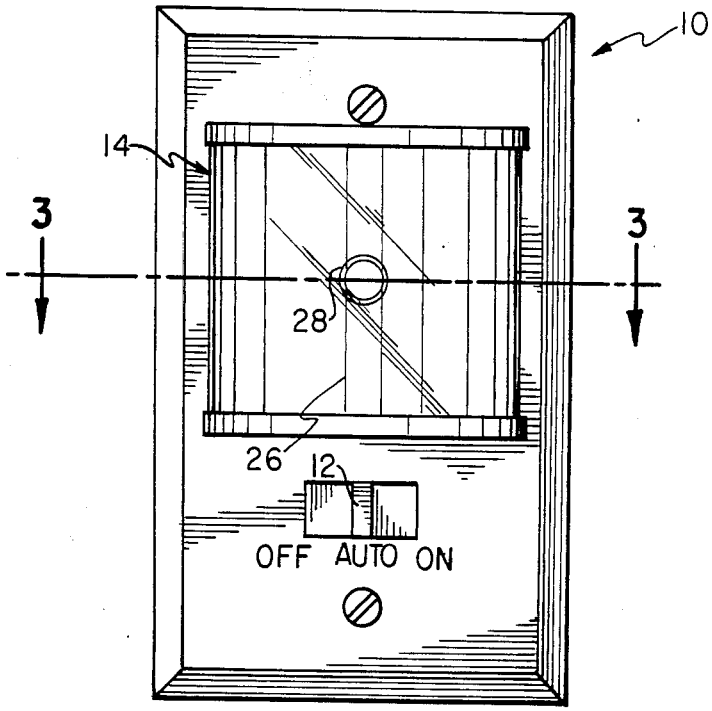
FIG. 2 is a front elevation of the wall mounted lighting control device of FIG. 1.

In FIG. 2 there is shown a front view of a lighting switch box which has the present invention installed therein. As can be seen from this view, a mode switch 12 is available on the front of the device 10. In the "off" position switch 12 prevents the lights from being turned on. In the "on" position it manually causes the lights to be on. However, when set in the "auto" position the lights will turn on only when an occupant is present in the room. FIG. 2 also shows a front view of a curved lens assembly 14 which determines the fields of view and which focus the infrared energy on a detector.

Figure 3:
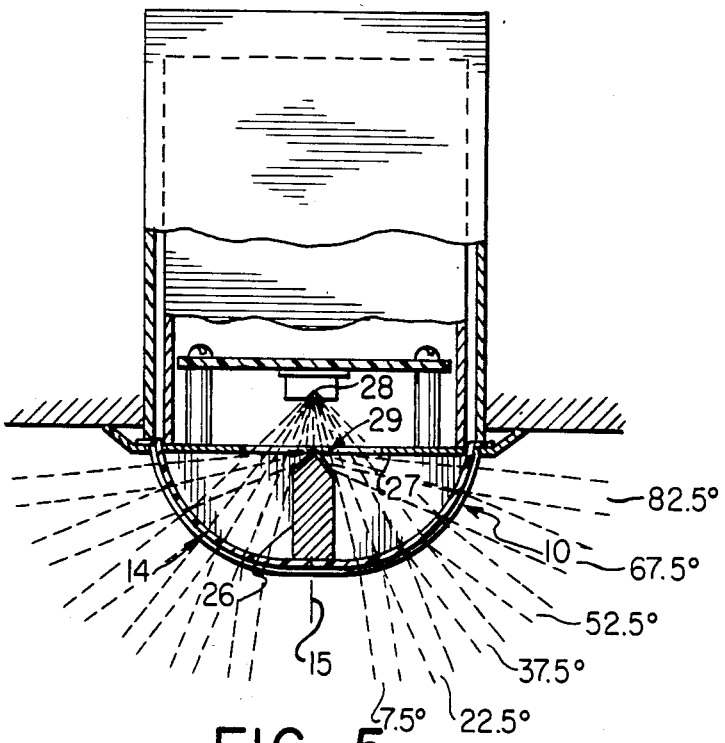
FIG. 3 is a cross-sectional view of the device of FIG. 2 substantially along line 3—3.

As more readily viewed in FIG. 3 the curved lens assembly 14 consists of twelve (12) lens segments. Six of these segments are to the left of the optical axis 15 of an infrared detector 28 and six (6) to the right thereof. The six lens segments to the left of axis 15 and the six to the right of axis 15 are mirror images of each other in this illustrative embodiment so the fields of view are similarly spaced on opposite sides of the axis 15. Since the left and right lens segments are mirror images, only one set of these lenses need be considered to obtain a complete understanding of the optical system. Thus, the six lens segments 20–25 to the right are considered in more detail in FIGS. 3 and 4. The first four lenses extending to the right from the optical axis have viewing areas which are 7.5°, 22.5°, 37.5° and 52.5° from the center axis of the detector 28. Each of these four lens segments 20–23 directly refract and focus infrared energy received at these angular positions into the infrared detector 28.

Lens segments 24 and 25 collect infrared energy at 67.5° and 82.5°, respectively, from the optical axis 15. Instead of attempting to direct this energy directly to the infrared detector 28, these lenses direct the energy onto a reflective surface 29 at the rear portion of a mounting block 26. From this reflecting surface 29 the energy is directed substantially along the optical axis 15 to the detector 28. If it were not for the reflective surface 29 the infrared energy received through the lenses 24 and 25 would approach the detector at an extreme acute angle. Due to the Lambertian sensitivities, this angle would be so great that the detector would be unable to register the energy received. Thus with the combination of off-axis lenses as well as reflective surface 29, the fields of view may be spread out over a wide range and the degradation in sensitivity due to Lambertian distribution is reduced.

Preferably the infrared detector sensing element 28 is made of lithium tantalate material. A Germanium window is located over the sensing element. In commercial form a fieldeffect transistor amplifier may be included in the case with the sensor. Such a device is sold by Eltec Instruments of Daytona Beach, Fla. as Model 40623.

The lens for the control unit comprises several contiguous segments of Fresnel lenses made of polyethylene material. A complete Fresnel lens would be in the form of a flat transparent flexible sheet of plastic material having concentric rings. The forward surface of each of these rings is at a slightly greater angle with respect to the perpendicular to the center of the lens. As a result the lens has the same general characteristics as a spherical lens with light passing directly through the relatively perpendicular lens segment at the center of the concentric circles of the Fresnel lens and light being bent to a greater extent in the concentric circles more remote from the center.

The further a segment of Fresnel lens is from the center, the more it bends light beams passing through it. This is true even if the center portion of the lens is not present in the segment. Thus, if it is necessary to bend an energy beam (including an infrared energy beam) by a particular amount, it is necessary only to determine the distance from the Fresnel lens center where there is a portion which causes the ray to bend by this amount.

Only that particular segment need be included in the optical system where the beam passes. For this reason segments off the center axis of the lens can be used and this type of optical device is referred to as an "off-axis" lens.

Figure 4:
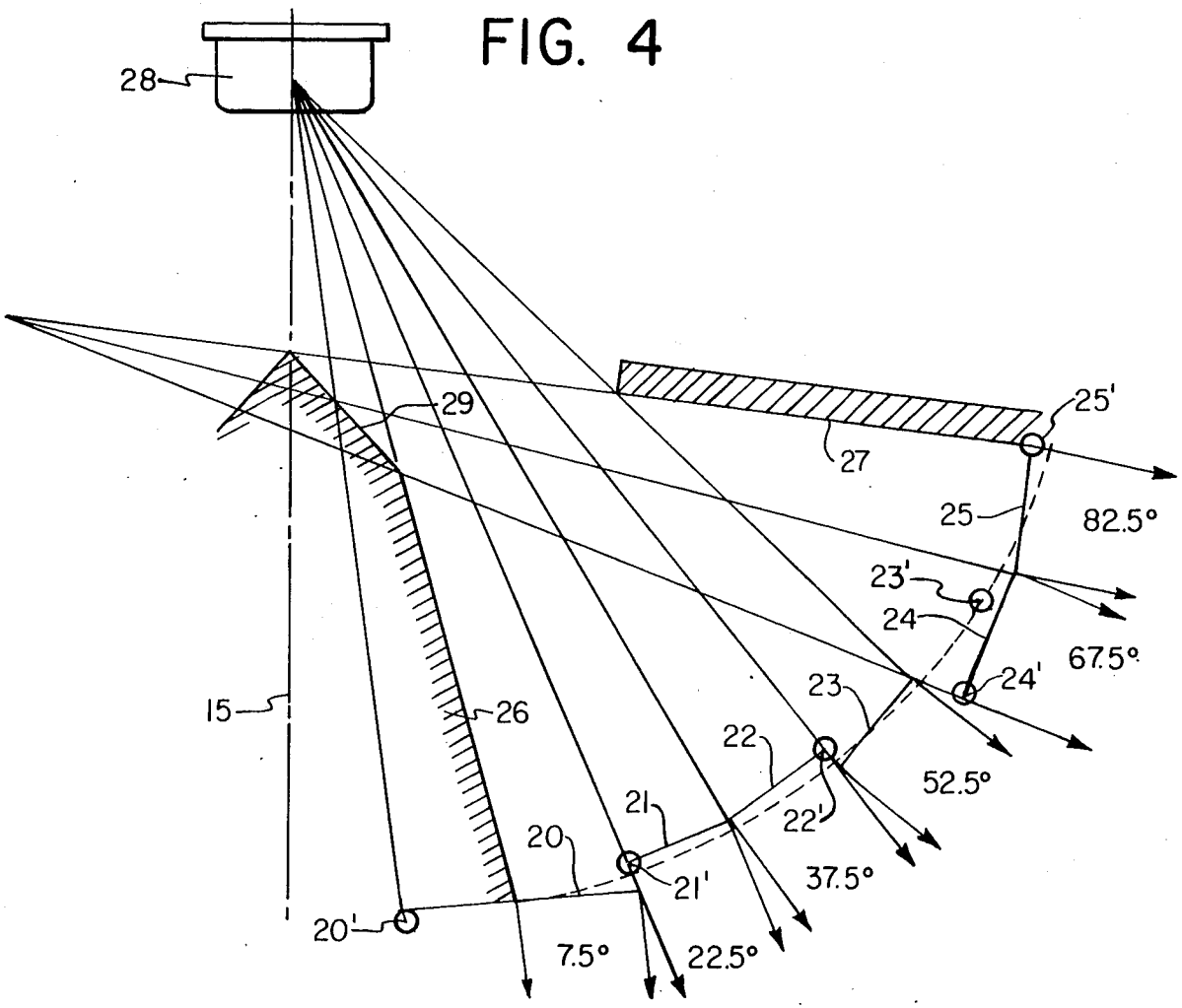
FIG. 4 is a layout of the optical path in the device of FIG. 3.

FIG. 4 shows the optical arrangement chosen for the present invention. It shows the general placement of the six Fresnel lens segments 20–25 to the right of the optical axis illustrated in FIG. 4. The first lens segment 20 is selected so that energy approaching the detector device at an angle of 7.5° will be bent such that it comes to focus at the detector 28. This lens element 20 has a complementary lens element on the other side of the reflector surface support 26 which also receives and focuses energy at 7.5°. These two elements together scan a 15° area directly towards the front of the detector. Because of the reflector support structure 26, however, there will be a small gap in the middle of this receiving field equal to the cross-sectional dimension of the support 26. This gap remains essentially constant throughout the field of view and is typically on the order of 1 inch.

The entire lens array is flexible and is bent into a curve shape as shown in both FIGS. 3 and 4. As a result it is only necessary for the lens element 20 to bend received infrared energy sufficient to come into focus at detector 28. An optical center 20' shows the location of the optical center of the Fresnel lens from which lens element 20 was selected. Lens segment 21 similarly focuses energy received at an angle of 22.5° onto the detector. The optical center of lens segment 21 is indicated as 21' in FIG. 4. Segments 22 and 23 are similar to the first two segments, except they are set to receive energy at 37.5° and 52.5°. Their optical centers are at 22' and 23'. It should be noted that for the lenses 20 and 21 the optical centers of the lenses from which they were selected are to the left of the segment. However, with respect to elements 22 and 23 the optical centers are to the right of the segments.

The ideal location for segments 20–23 are shown in solid line in FIG. 4. However, since it would be inconvenient to have lens segments in these positions, the segments are positioned along the dotted line curve as shown. Thus there will be a slight defocusing of the infrared energy, but this is so slight as not to create a serious problem.

Lens segments 24 and 25 are arranged differently than lens segments 20–23. In particular lens segments 24 and 25 are arranged so that energy received at 67.5° and 82.5° is bent so that it contacts reflective surface 29 and is reflected into detector 28. The optical centers for the lens segments are at 24' and 25', respectively. Since the path from segments 24 and 25 to the detector are somewhat longer than for segments 20–23, lenses 24, 25 are made from a different Fresnel lens having a longer focal length. In particular lenses 20–23 have a 1.15 inches focal length and lenses 24,25 have a focal length of 1.35 inches in the illustrated embodiment.

As shown fairly well in FIG. 3, there is an optical baffle 27 through which the infrared energy must pass after passing through the Fresnel lenses and reflecting off surface 29. This baffle is arranged to allow all of the desired infrared energy to reach the detector, but to block out extraneous energy. The location of this baffle is also pictured in FIG. 4 where it is shown to be positioned such that the energy received by lens 23 may just pass its end and reach the detector, and the energy received by lens 25 passes parallel to it and contacts the reflector surface 29 which bends it toward the detector 28 through the opening in the baffle.

If it is found desirable to have additional fields of view, the number of lens segments can be increased. The number of fields of view can also be decreased by decreasing the number of lens segments. Further, the angles at which the fields of view are set up can be varied by varying the portion of the Fresnel lens from which a segment is selected. In particular, the further away from the optical center that the lens the segment is selected, the greater it will bend the incident infrared energy.

By using the optical arrangement shown in FIG. 4 the fields of view for the detection device can be spread out over 180° or more. In addition, a particular number of fields of view can be selected by choosing the proper number of lens segments and the position of each individual field of view can be varied by selecting its lens segment from particular portions of a Fresnel lens of particular optical power.

Figure 5:
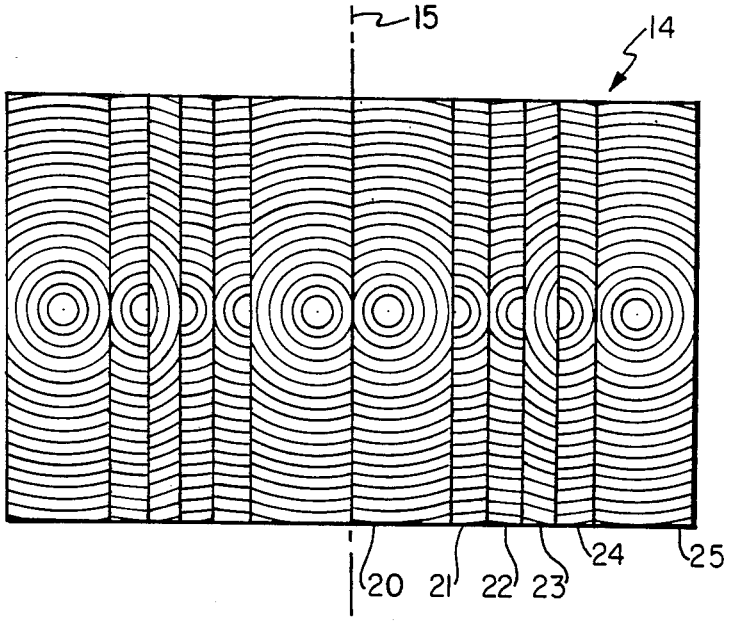
FIG. 5 is a front elevational view of the lens assembly of the device of FIG. 2 when laid out in a plane.

As best seen in FIG. 5 the lens segments to either side of the center line 15 are mirror images of each other and thus the analysis set forth in FIG. 4 for lenses 20–25 could be repeated for the lenses on the other side of the reflector support 26. In addition, FIG. 5 shows that the optical center of some of the lenses can be viewed in the segment piece selected, while in others the segment selected is so remote from the optical axis that the optical center of the lens cannot be seen and is not present in the lens segment.

The combination of off-axis lens elements of different focal length and reflecting surfaces does not readily lend itself to a single contiguous set of lens elements. Careful selection and placement of the various geometries results in a set of discontinuous elements, each skewed at some angle to the other. The net result of this is an optical system which combines a dual mirrored surface with dual focus, off-axis contiguous lens segments which are flexible and curved.

As previously noted the detector has a sensitivity that drops off as the incident rays reach it at greater angles. With the arrangement shown in FIG. 4 the sensitivity is made more uniform by using reflective surface 29 to direct the energy from the most extreme angles directly into the detector. The result is to create a sensor with approximately plus or minus 15% maximum variation in sensitivity for any field of view over an arc of 180°.

Figure 6:
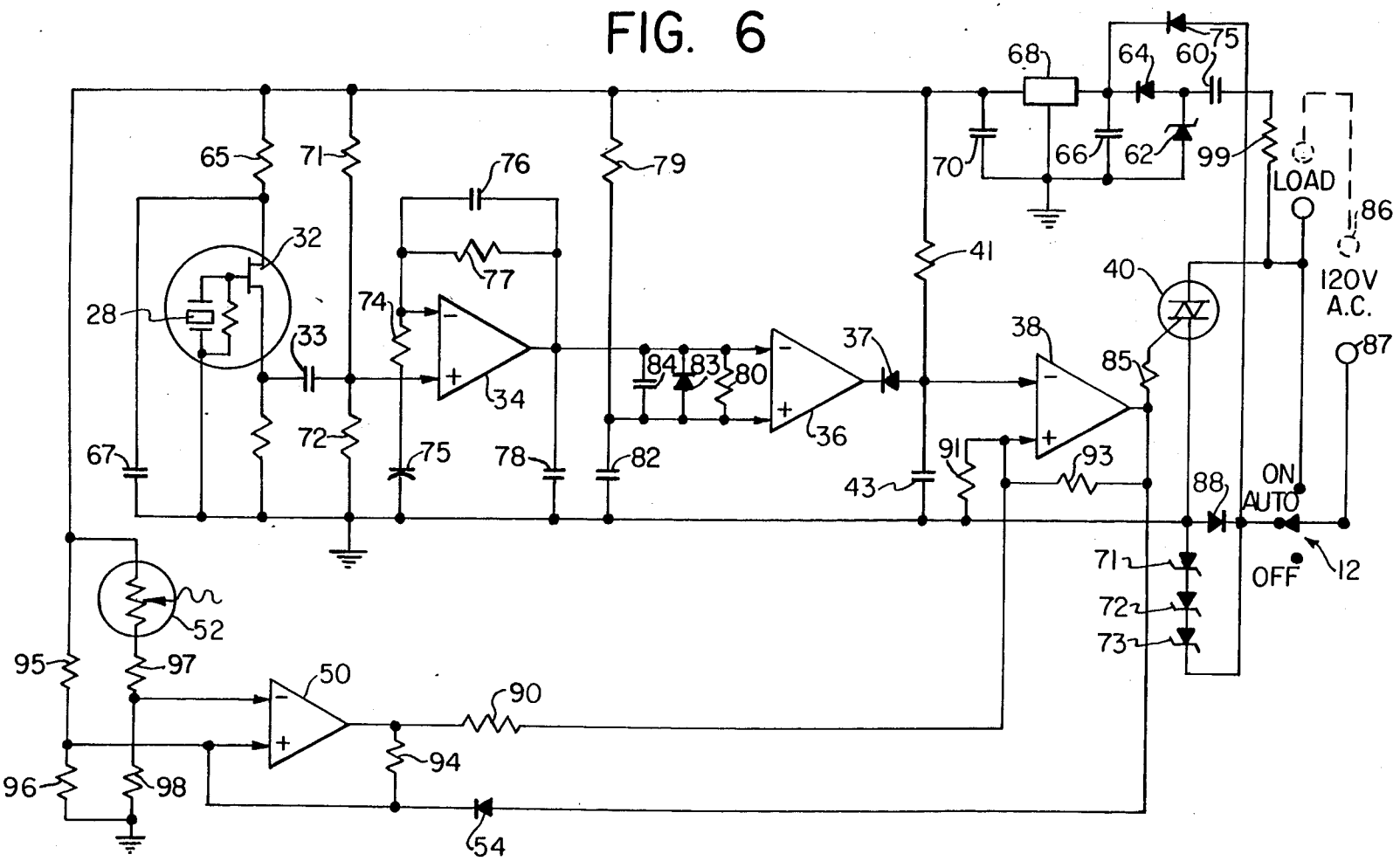
FIG. 6 is an electrical schematic of the control circuits of the device of FIG. 2.

An electrical circuit for operating in conjunction with the sensor and for controlling the electrical lights in a room or area is shown in FIG. 6. In the present system, motion is seen as a change in infrared radiation by the infrared detector 28. This motion is an indication that a room or area is occupied and that the lights should be turned on.

In FIG. 6 the detector 28 is shown as a lithium tantalate crystal which is connected to a field effect transistor 32 arranged as a source follower. This source follower transistor 32 acts as a preamplifier. Resistor 65 and capacitor 67 decouple the preamplifier from the power supply, which reduces the effects of power supply variations and eliminates parasitic oscillations. The signal from the source follower transistor 32 is passed through a capacitor 33 to the non-inverting input of operational amplifier 34. This a.c. coupling through capacitor 33 eliminates background infrared information and passes only that signal representing a change in infrared signal.

The values of bias resistors 71,72 as well as capacitor 33 are chosen to limit the low frequency response of amplifier 34 to approximately 0.5 Hz. Resistor 74 is connected in series with a capacitor 75 between ground and the inverting input of amplifier 34 These are also chosen to limit the low frequency response of the amplifier. Feedback capacitor 76 and resistor 77 are chosen to limit the high frequency response of the amplifier to 10 Hz. A capacitor 78 is connected between the output of the amplifier 34 and ground in order to eliminate parasitic oscillations.

The output of amplifier 34 is directly coupled to a comparator circuit 36 at its inverting input. A threshold voltage for the comparator 36 is set by resistors 79 and 80. The resistor 80 and capacitor 82 control the low frequency response of the comparator. The high frequency response is controlled by resistor 80 and capacitor 84.

The output of comparator 36 is normally at a high level and switches to a low level when a positive signal exceeding the threshold voltage is applied to the inverting input. When the signal is negative and of sufficient amplitude, diode 83, which is connected between the inverting and non-inverting inputs of the comparator, will conduct and change the reference voltage on the non-inverting input. As a result the output will switch to a low level when the signal returns to normal.

The low level which is generated at the output of comparator 36 when motion is detected, is coupled through a diode 37 to the inverting input of a comparator 38. This signal causes the output of comparator 38 to switch to a high level which is coupled through current-limiting resistor 85 to the gate of a triac 40, causing it to switch on. With triac 40 on, current flows through the load which is typically the ballast of a fluorescent lighting system. The turning on of triac 40 completes the circuit between one line 86 of the 120 volt a.c. supply, the load, the triac 40, a diode 88, switch 12 and the other side 87 of the 120 volt supply.

When the low signal from comparator 38 ends, capacitor 43, which was previously discharged through diode 37, starts to charge again through a resistor 41. When the voltage across capacitor 43 exceeds the comparator 38 threshold voltage, the triac will be switched off, thus removing the voltage from the lighting load. Capacitor 43 and resistor 41 are selected so that there is a delay of several minutes before the triac is turned off, once it has been turned on. This gives the system sufficient time to monitor the room for any movements. Thus, if an occupant is in the room, but is remaining relatively stationary for a period of time, the lights will continue to remain on. Only after several minutes without the detection of motion, will the lights finally turn off.

In FIG. 6 resistor 90 is part of a photo-override circuit. This resistor 90 and a resistor 91 establish the comparator threshold voltage for comparator 38. Resistor 93 connected between the output and non-inverting input of comparator 38 provides hysteresis which prevents the rapid switching on and off of the circuit due to noise as the voltage on capacitor 43 crosses the comparator threshold.

In the photo-override circuit resistors 95 and 96 set the threshold voltage of a comparator 50. When the illumination level in a room is low, the resistance of a photo-resistor 52 is high. This causes a low level at the inverting input of comparator 50 due to resistors 97, 98. The low level creates a high level at the output of comparator 50 across resistor 94 in the absence of other ambient light. This high level permits comparator 38 in the main switching circuit to operate as previously described. However, when the illumination level in an area is increased, for example due to sunlight entering a window, the photoresistance decreases to the point where the voltage at the inverting input of comparator 50 exceeds the threshold. This causes the output of comparator 50 to switch to a low level which inhibits comparator 38 from operating. It accomplishes this by lowering the voltage at the non-inverting input of comparator 38 through resistor 90, if comparator 38 is in the off position. If comparator 38 is in the on condition, its output voltage is applied to the non-inverting input of comparator 50 through a diode 54, which inhibits the operation of the photo-override circuit.

In addition to the automatic operation, switch 12 allows for manual override of the normal operation of the circuit. In the "off" position the 120 volt line is opened by switch 12. In the "on" position the triac is by-passed so that the 120 volt line voltage is directly applied to the load.

In order to power the control circuit a power supply is provided. When the triac 40 is off, capacitor 60 and resistor 99 pass a.c. current to a Zener diode 62. Resistor 99 prevents a capacitor 66 from delivering destructively high peak currents to the triac when it switches on. The a.c. voltage is half-wave rectified by Zener 62 and is applied through a diode 64 to capacitor 66. This capacitor filters the half-wave voltage before it is applied to the input of a regulator integrated circuit 68. Diode 64 prevents capacitor 66 from discharging through capacitor 60. Typically the integrated circuit regulator 68 produces a 5-volt output level which is further filtered by an additional capacitor 70.

With a device that is mounted in the wall switch box, when triac 40 is on the 120 volt signal is not available for use in the power supply directly. Therefore, a low voltage a.c. half-wave signal is developed across Zener diodes 71–73 and applied to filter capacitor 66 through a diode 75. Diode 88 reduces the heat generated in the Zener diodes 71–73 due to conduction in the forward direction.

Figure 7:
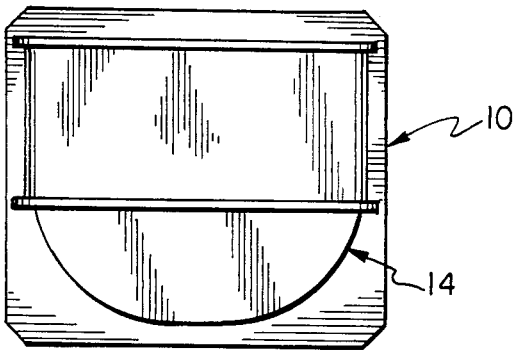
FIG. 7 is a plan elevation of a table-mounted lighting control device according to the present invention.
Figure 8:
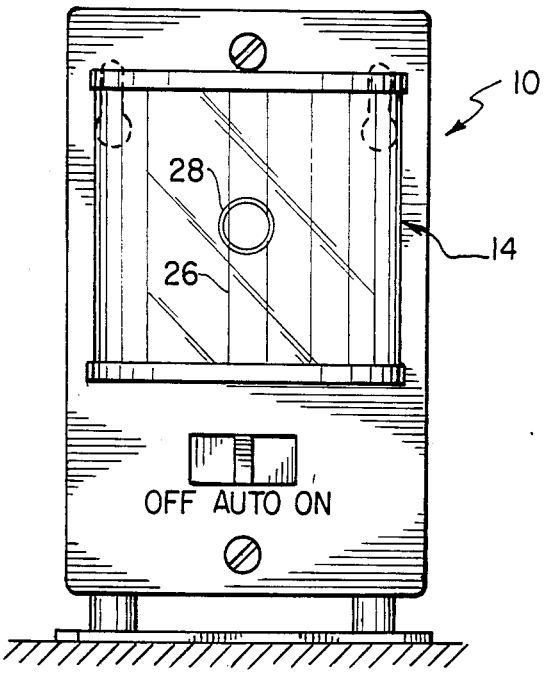
FIG. 8 is a front elevation of the device of FIG. 7.

As an alternative to mounting the control device in a wall panel, it may be provided with its own pedestal such that it may be placed on any horizontal surface which is thirty to forty-eight inches above the floor. Such a device is shown in FIGS. 7 and 8. It may also be hung on any wall at the same height using mounting keyholes on the back. Whatever way it is mounted it should be oriented to cover an area where detection is desired.

Provision is made in this device so that it may be plugged into a wall socket and a light or other appliance may be plugged into it. Since it is plugged into a wall socket, 120 volts a.c. is always available, even when the triac is on. Consequently, the Zener diodes 71–73 and associated circuitry in FIG. 6 may be eliminated in the power supply for this alternative device. Instead the 120 volt signal is merely applied directly across zener 62 and capacitor 60.

It should be understood that the fields of view of either the wall-mounted or table-mounted device are spread out in a horizontal plane approaching 180°, but the field of view is relatively narrow in vertical spread. Further, the fields of view are arranged at about the height of a lighting switch above the floor. It is only motion in these fields of view which is detected. Thus if the device were positioned so that the fields pass about two feet above a bed in a room, when the person lies down in the bed the beams will pass above his body without making contact. After several minutes the lights in the room will go out, even though the person may move in his sleep, because the fields of view are too high. However, should the person rise up in bed or get out of bed, his body will enter the fields of view of the device and the light will come on automatically.

While the invention has been particularly shown and described with reference to preferred embodiments thereof, it will be understood by those skilled in the art that various changes in form and details may be made therein without departing from the spirit and scope of the invention.

What is claimed is:

1. A lighting control device for controlling the flow of electrical energy to electrical lights, comprising:

means for controlling the flow of electrical energy between a source of electrical energy and a load in the form of electrical lights, in accordance with a control signal;

passive infrared detector means for generating an electrical signal relating to infrared energy received thereby; said infrared detector means having an optical center axis;

control circuit means coupled to said detector and to said controlling means for generating said control signal;

a segmented off-axis lens for creating a plurality of fields of view for said detecting means, said fields of view extending over an arc exceeding 90 degrees, said lens comprising a plurality of selected lens segments, said segments being arranged in a series in front of said detectors means; at increasing angular positions to the perpendicular to the optical center toward a first end, at least one reflective surface at an acute angle with respect to the center axis of said detector and positioned between said lens and said detector along the center axis of said detector, said reflective surface reflecting infrared energy passing through at least one of the respective segments at said first end of said segmented lens toward said detector.

2. A lighting control system device as claimed in claim 1 wherein the means for controlling is a triac.

3. A lighting control device as claimed in claim 1 wherein said passive infrared detector means is made of lithium tantallate covered by an infrared transparent geramium window.

4. A lighting control device as claimed in claim 1 wherein the lens is made from a plurality of selected segments from Fresnel lenses, said segments being arranged in a series along a curve in front of said detector means such that the segments extend from one end of the lens to a center section and from the center section to the other end of the lens.

5. A lighting control device as claimed in claim 1 wherein corresponding segments on opposite sides of the center axis of the detector are mirror images of each other, such that the fields of view on one side of the center axis are at the same angles as the fields of view on the other side of the center axis.

6. A lighting control device as claimed in claim 4 wherein said detector means optical center axis is aligned with the center section of said lens, and further including at least two reflective surfaces at an angle with respect to each other and positioned between the center section and said detector along the center axis of the detector, each of said reflective surfaces reflecting infrared energy passing through at least one of the respective segments at the ends of the lens toward said detector.

7. A lighting control device as claimed in claim 6 wherein said fields of view extend over an arc at least approaching 180°.

8. A lighting control device as claimed in claim 6 wherein the focal length of the segments whose infrared energy is reflected by the reflective surfaces is greater than the focal length of the other segments.

9. A lighting control device as claimed in claim 1 wherein the device is located in a wall switch box as a substitute for the wall switch, and further including a manual switch having at least on, off and automatic positions, in the on position the switch directly completes the connection to the electrical lights and by-passes the means for controlling, in the off position the connection from the electrical energy source to the means for controlling is opened, and in the automatic position the electrical energy from the source is passed to the means for controlling.

10. A lighting control device as claimed in claim 9 wherein the electrical energy is a.c. voltage, and further including a source of d.c. voltage for the detector, first circuit and second circuit, when said switch is in the automatic position and said means for controlling it on said d.c. voltage being derived from at least one Zener diode connected in series with the means for controlling, and when said means for controlling is off said d.c. voltage being derived from said source directly.

11. A lighting device as claimed in claim 1 further comprising:

a photodetector means producing an electrical light sensing signal indicative of the ambient light in the area of the device, and a photocircuit means for producing an output level when the light sensing signal is greater than a predetermined level, the output of said photocircuit means inhibiting the operation of said device such that electrical energy is inhibited from reaching said electrical lights.

12. A lighting control device as claimed in claim 1 wherein the device is mounted on a pedestal which may be positioned on a horizontal surface, the electrical energy being supplied to the device from a wall socket through a first electric cord and the electrical lights means connected to the device through a second electrical cord, said first and second electrical cords each having at least two wires.

13. The lighting control device according to claim 1 wherein said lens segments are comprised of segments from Fresnel lenses.

14. The lighting control device according to claim 13 wherein said control circuit means comprises:

first circuit means for detecting when changes in said electrical signal exceed a predetermined level and producing a predetermined signal level in response thereto; and second circuit means for creating said control signal in response to said predetermined signal level, said second circuit means including a delay circuit for maintaining said control signal for a fixed period of time after said signal level is removed.

15. An optical arrangement for creating a plurality of selected angularly spaced apart fields of view for an energy detector, which fields of view are spaced over an arc about an optical center axis of said detector, which arc exceeds 90 degrees, comprising:

a plurality of selected Fresnel lens segments arranged in series along a curve in front of the detector so as to form a lens, each segment representing a different one of the selected fields of view, said lens having a center segment aligned with the detector optical center axis and respective ends; and at least one reflective surface positioned in front of the detector behind the center segment of the lens, said surface reflecting the energy passing through the segments at the respective ends of the lens nearly directly and perpendicularly into the detector, such that the lens sensitivity is made more nearly equal for each segment, the segments which pass energy directly to the detector being selected from a portion of a Fresnel lens of a particular magnification, including those portions off the lens axis, which refract the energy from the selected field of view into substantial focus at the detector, the segments which pass energy to the detector after reflection from the reflector surface being selected from a portion of a Fresnel lens of a particular magnification, including off axis portions, which refract the energy from the selected field of view into substantial focus at the detector after reflection at the reflector surface.

16. An optical arrangement as claimed in claim 15 wherein said energy detector is an infrared energy detector.

17. An optical arrangement as claimed in claim 16 wherein said infrared energy detector is made of lithium tantalate and is covered by a germanium window.

18. An optical arrangement as claimed in claim 15 wherein the detector has a Lambertian distribution of sensitivity and at the optical center axis the sensitivity is greatest, said lens segments on either side of the center section being mirror images of each other such that the fields of view to one side of the optical axis angularly correspond to those on the other side.

said at least one reflective surface being in the form of two reflective surfaces at an angle with respect to each other and positioned behind a portion of the center section of the lens, said surfaces reflecting the energy passing through the segments at respective ends of the lens to the detector such that the lens sensitivity is made more nearly equal for each segment, said fields of view being spread over an arc of nearly 180 degrees.

19. An optical arrangement as claimed in claim 18 wherein there are six fields of view on each side of the optical center axis, with six corresponding segments on each side of the center section of the lens, and wherein the reflective surfaces reflect the energy of the two respective end-most segments on each side.

20. An optical arrangement as claimed in claim 19 wherein the focal length of the segments which are reflected is greater than the focal length of the other segments.

21. An optical arrangement as claimed in claim 19 wherein the fields of view on both sides of the center axis are approximately 7.5°, 22.5°, 37.5°, 52.5°, 67.5° and 82.5°.

* * * * *